United States Patent [19]

Araya

[11] Patent Number: 4,619,520

[45] Date of Patent: Oct. 28, 1986

[54] VARIABLE MAGNIFICATION ELECTROPHOTOGRAPHIC COPYING APPARATUS

[75] Inventor: Junji Araya, Yokohama, Japan

[73] Assignee: Canon Kabushiki Kaisha, Tokyo, Japan

[21] Appl. No.: 572,847

[22] Filed: Jan. 23, 1984

[30] Foreign Application Priority Data

Jan. 26, 1983 [JP] Japan ..... 58-9970

[51] Int. Cl.[4] ..... G03G 15/00

[52] U.S. Cl. ..... 355/14 R; 355/14 E; 355/69

[58] Field of Search ..... 355/14 R, 14 E, 14 CH, 355/14 D, 14 C, 67, 68, 69, 77, 55; 430/30, 31

[56] References Cited

U.S. PATENT DOCUMENTS

| | | | |
|---|---|---|---|
| 2,956,487 | 10/1960 | Giaimo, Jr. | 355/14 D |
| 4,215,930 | 8/1980 | Miyakawa et al. | 355/14 D |
| 4,285,593 | 8/1981 | Vinatzer | 355/55 Y |
| 4,306,804 | 12/1981 | Sakamoto et al. | 355/14 E |
| 4,411,514 | 10/1983 | Komori et al. | 355/14 CH |
| 4,474,460 | 10/1984 | Suzuki | 355/69 X |

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

An image forming apparatus includes magnification selector for setting magnification of an image to be formed, an image forming device for forming an image in the magnification set by said magnification selector, automatic density regulator for automatically regulating the density of the image to a proper value, and corrector for making a correction in dependence of the set magnification to the automatic density regulator.

13 Claims, 13 Drawing Figures

VARIABLE MAGNIFICATION ELECTROPHOTOGRAPHIC COPYING APPARATUS

BACKGROUND OF THE INVENTION

1. Field of the Invention

The present invention relates to an image forming apparatus such as copying machines, facsimiles, printers or their combination and particularly an image forming apparatus comprising magnification changing means for changing the size of an image to a selected size and automatic density regulating means for automatically or semi-automatically controlling the density of the image.

2. Description of the Prior Art

Recently, a mechanism for automatically regulating the density of an image has been incorporated into some image forming apparatus which forms an image from an original or in accordance with signals, such as copying machines, facsimiles or printers.

For example, U.S. Pat. No. 4,215,930 discloses a copying machine in which the reflected light from an original is received by a photosensor to detect the density of the background of the original and control the development bias in accordance therewith.

On the other hand, electrophotographic systems have currently be widely utilized as copying machines. Some of the electrophotographic systems are provided with a magnification changing mechanism for permitting an image formation from an original in the desired size, that is, one-to-one size, an enlarged size or a reduced size.

In general, the automatic density regulating mechanism is adapted to process the density of an image to be formed in accordance with a predetermined manner. There will, therefore, be a difference in density between images formed in a changed magnification and the unit magnification. Such an automatic density regulating mechanism sometimes cannot function to obtain a proper image.

There will now be described the key section of one example of the conventional automatic density regulating systems.

In the example of the prior art automatic density regulating systems used in copying machines or the like, an original is scanned prior to the actual copying step to measure potentials in a latent image formed in a photosensitive member and integrate the measurements over the range of scan. The integration is then used as a detection of the density of the image on the original.

Referring to FIG. 1, prior to the actual copying step, an optical system is moved from the start point P to the end point Q in the direction of arrow A to illuminate the original with the light from a halogen lamp 7 in the optical system such that a latent image of the original O will be formed on a photosensitive drum 1. Potentials on the latent image are measured by a potential sensor 2, and the measurements are integrated by an integrating circuit 4. The integration is taken as the density of the original. This integration is one obtained by integrating the potentials with time required to move the optical system from the point P to the point Q. If the speed of the optical system is changed to vary the magnification in which an image is to be formed, however, the time required to move the optical system from the point P to the point Q also is naturally changed to provide a different integration. For example, if it is assumed that the time required to move the optical system from the point P to the point Q is t and the time constants is I in the one-to-one copying mode (unit magnification), the integration is $100\{1-e-(t/I)\}$ (V). If the optical system is moved at a speed 1/0.7 times that of the one-to-one copying mode to vary the magnification to a reduction of 0.7, the integration time is equal to 0.7 t. If this time is used to integrate the constant potential of 100 V on a latent image of a half-tone original having the same density, the resulting integration becomes $100\{1-e-(0.7t/I)\}$ (V). In other words, the same original may be judged to have different densities if the optical system is moved at different speeds. If a copying step is executed controlling the amount of light without correcting the erroneous density measurement, a proper copy will not be obtained when the magnification is changed.

As long as one of the components of the optical system including an original carriage and optical parts such as mirrors, lamps and others is adapted to move at a different speed if the magnification is changed from one to another, a proper image could not always be obtained even if the density of an original was detected by other types of conventional means.

It is thus desired to provide a suitable system for effectively overcoming such a problem in the conventional automatic density regulating mechanism and particularly in an apparatus including means for moving a movable image forming member at different speeds matching the selected magnifications.

SUMMARY OF THE INVENTION

It is therefore an object of the present invention to provide an image forming apparatus comprising automatic image density regulating means and magnification changing means, in which an error produced in the density regulation when the magnification is changed can be corrected such that the desired density of an image will always be obtained in any magnification.

Another object of the present invention is to provide an image forming apparatus which can overcome the above described problems and control the density (contrast) of the formed image even if an optical system component is moved at different speeds.

In accordance with one aspect of the invention, there is provided a variable magnification electrophotographic copying apparatus comprising image forming means for applying light reflected by an original to be copied to form an image of the original, said image forming means including speed changing means for changing the speed of a movable member for image formation in accordance with a desired magnification of copy, magnification setting means for setting a one-to-one mode wherein the image is formed in a unit magnification and a magnified mode wherein the image is formed in a non-unit magnification, detecting means for detecting information corresponding to a density of the original using the light reflected by the original, automatic density control means, responsive to said detecting means, for automatically controlling a density of the image formed, and automatic correcting means for correcting, in the magnified mode, said automatic density control means in accordance with the speed at which the movable member is moved based upon the magnification set by said setting means.

In accordance with another aspect of the invention, there is provided a variable magnification electrophotographic copying apparatus, comprising a movable photosensitive member, image forming means for forming an image corresponding to an original to be copied on said photosensitive member, magnification setting means for setting a magnification in which the image is formed on said photosensitive member, detecting means for detecting information corresponding to a density of the original and image density control means, responsive to said magnification setting means and to said detecting means, for setting an image formation parameter with which said image forming means operates, for a unit magnification and for a non-unit magnification, said control means including means for integrating the information of the density to adjust the parameter and means for correcting the integrating operation of said integrating means in accordance with the magnification set by said setting means in the magnified mode.

In accordance with a further aspect of the invention, there is provided a variable magnification electrophotographic copying apparatus, comprising image forming means for forming an image corresponding to an original to be copied, magnification setting means for setting a one-to-one mode wherein the image is formed in a unit magnification and a magnified mode wherein the image is formed in a non-unit magnification, automatic density control means for controlling in an automatic mode a density of the image in accordance with information corresponding to a density of the original, manual density control means for manually controlling in a manual mode a density of the image, an automatic density control circuit for determining an image formation parameter with which said image forming means operates, in accordance with the information corresponding to the density of the original and with the magnification set by said magnification setting means in the automatic mode and a manual density control circuit for determining the image formation parameter irrespective of said automatic density control circuit.

There has thus been outlined the more important features of the invention in order that the detailed description thereof that follows may be better understood and in order that the present contribution to the art may be better appreciated. There are, of course, additional features of the invention which will be described hereinafter and which will form the subject of the claims appended hereto.

DESCRIPTION OF THE PREFERRED EMBODIMENTS

Embodiments of the present invention will now be described with reference to the drawings.

Figure 1:
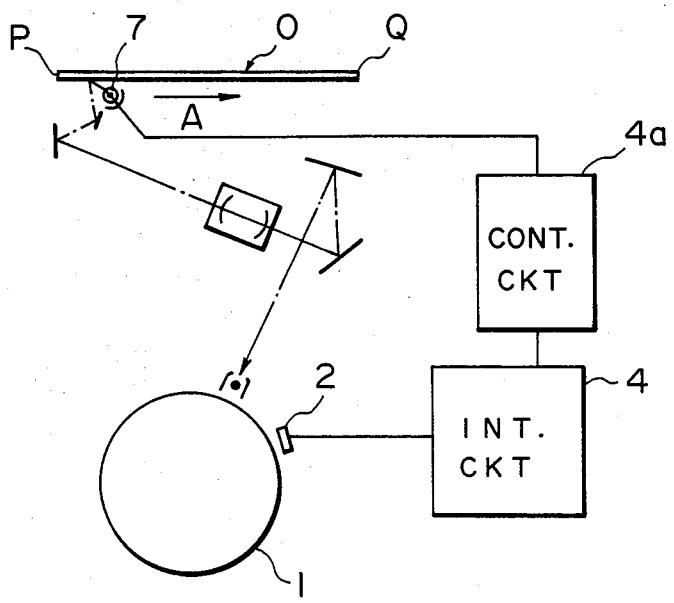
FIG. 1 PRIOR ART
FIG. 1 is a schematic illustration of the conventional copying machine.
Figure 2:
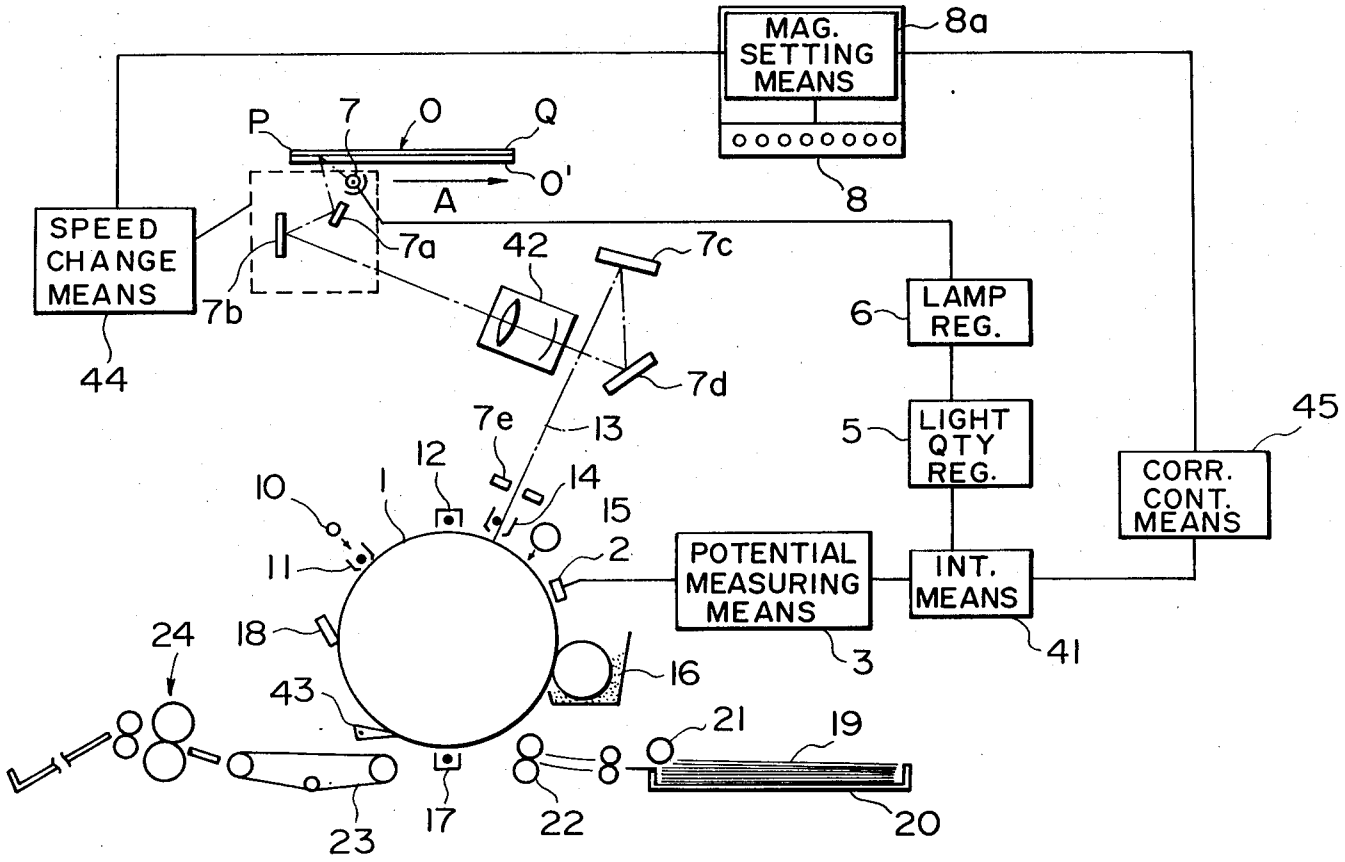
FIG. 2 illustrates an example of the image forming apparatus according to the present invention.

FIG. 2 is a schematic side view showing a copying machine representative of image forming systems to which the present invention can be applied. The copying machine comprises an original carriage O' on which an original O is placed; a halogen lamp 7 used as a light source for illuminating the original O; mirrors *7a, 7b, 7c* and *7d;* a slit *7e* and an imaging lens 42 fixed to the machine frame. The mirrors and lens form an optical system through which the original is imaged on a photosensitive drum 1 to form a latent image thereon. The photosensitive drum 1 may be an image bearing member including a photosensitive layer and an insulating surface layer, which member serves to form a latent image in accordance with an electrophotographic method based on the so-called NP process disclosed in Japanese Patent Publication No. 42-23910. The photosensitive drum 1 is rotatably supported on the machine frame. Around the photosensitive drum 1 are disposed a light source 10 such as a tungsten lamp functioning as pre-exposure means; a charge remover 11 for eliminating the residual charge on the photosensitive drum 1; a primary corona discharger 12 for effecting a corona discharge; a secondary corona discharger 14 which functions to effect AC corona discharge having a component of polarity opposite to that of the ordinary corona discharge, DC corona discharge with its polarity opposite to that of the primary corona discharge or a combination of the AC corona discharge with the DC corona discharge, at the same time as the surface of the photosensitive drum 1 is exposed to the optical image from the original O as shown by 13 in FIG. 2; a whole exposure lamp 15; a potential sensor 2; a developing device 16 for developing the electrostatic latent image formed on the photosensitive drum 1 with a powdered developer; a transfer corona discharger 17 for transferring the developed image onto a transfer material 19, which is supplied from a cassette 20 by paper feed means including a feed roller 21 and registration rollers 22; and cleaning means 18 for removing the residual developer from the photosensitive drum 1 after the transfer step.

As in the conventional copying machines, this copying machine also comprises separation means 43 for separating the transfer material having the transferred image from the photosensitive drum 1, means 23 for conveying the separated transfer material, fixation means for fixing the powder image to the conveyed transfer material and so on.

The potential sensor 2 is located close to the surface of the photosensitive drum 1 between the secondary corona discharger 14 and the developing device 16 and functions to detect the surface potential of the latent image on the photosensitive drum 1.

Potential measuring means 3 is provided to convert surface potential signals from the potential sensor 2 into signals having a proper level which are in turn supplied to an integrating means 41.

Light quantity regulating means 5 is provided to supply a control signal to a lamp regulator 6 such that a proper amount of light will be provided in accordance with the integration of surface potentials (that is, density of the original) processed at the integrating means 41, whereby the halogen lamp 7 can be controlled to provide a proper illumination of the original.

An operational part 8 is provided including magnification setting means 8*a* for changing and setting the size of an image to be formed relative to the size of the original.

When a magnification is determined manually or by any suitable electric signal, a signal representative of that magnification, which is one of one-to-one, enlargement or reduction is supplied to speed change means 44 for controlling the speed of the optical unit (7, 7*a*, 7*b*) and also correction controlling means 45. The speed change means 44 functions to move the optical unit (7, 7*a*, 7*b*) at a predetermined speed matching the set magnification. In the present embodiment, the original carriage O' is stationary. However, the original carriage O' may be movable with the optical unit (7, 7*a*, 7*b*) being stationary. In this case, the speed change means 44 will control the motional speed of the carriage O'.

The correction control means 45 functions to add a predetermined correcting value, matching the set magnification, to the result obtained from the integration in the potential measuring means 3 which detects the density on the original. Thus, information of density may be supplied to the light quality regulating means 5 without influence of the change of magnification so that a proper density will be obtained without error due to the change of speed. A specific circuit including the above means is exemplified in FIG. 7.

The photosensitive drum 1 comprises a cylinder of aluminium, a photosensitive layer located around the outer periphery of the cylinder and including cadmium sulfide doped with copper and an adhesive resin, and an insulative resin layer disposed over the photosensitive layer.

FIG. 3 shows a relationship between the potential upon detection of the density of the original and the integration by the integrating circuit in the copying machine which relates to the present invention.

In the above arrangement, a process for obtaining an image is carried out in accordance with the following procedure:

First of all, the optical unit including the halogen lamp 7, mirrors 7*a* and 7*b* and others is scanningly moved at a speed matching the set magnification in the direction of arrow A to expose the photosensitive drum 1 to the optical image of the original to form an electrostatic latent image thereon, prior to the actual copy scan. This is for the automatic density regulation which will be described below. The surface potential of this electrostatic latent image is detected by the potential sensor 2. The potential measuring means 3, the integrating means 41, the light quantity regulating means 5, the lamp regulator 6 and the correction control means 45 regulate the exposure of the halogen lamp 7 to an amount required to obtain an image with its proper density.

Subsequently, the photosensitive drum 1 is subjected to the pre-exposure by the light source 10 as pre-exposure means and to charge-removal by the charger remover 11. The primary corona discharger 12 is energized by a voltage of 7.0 KV to uniformly charge the surface of the photosensitive drum 1. The potential given by the primary discharge is about 1500–2000 V. Subsequently, the optical unit is again moved at the same speed to expose the photosensitive drum 1 to a proper light beam 13 from the halogen lamp 7 regulated to provide a proper exposure. At the same time, a voltage of −8.0 KV is applied to the secondary corona discharger 14 for corona charge removal. Finally, the surface of the photosensitive drum 1 is uniformly irradiated by the whole exposure light source 15 such as a fluorescent lamp of 20 W such that the formation of electrostatic latent image will be completed. Upon the exposure of optical image, the surface potential in the electrostatic latent image is about +500 V at the region of the photosensitive drum 1 which is not irradiated by the light and about zero volt at the drum region which corresponds to the white-colored background of the original O irradiated by the light.

The electrostatic latent image so formed is then visualized by the developing device 16, for example, by forming a powder image under a so-called jumping development. Subsequently, the powder image is transferred onto a transfer material superimposed thereon under the action of a transfer corona discharger 17. After the transfer step, the transfer material is separated from the photosensitive drum 1 and fed to a fixing device whereat the toner image is fixed to the transfer material.

The automatic density regulation is initiated at the first scanning movement of the optical unit for detecting the density of the image on the original O and terminated before the original O is scanningly irradiated by the exposure light source for actual image formation. The speed of the optical unit (7, 7*a*, 7*b*) is varied depending on the copying mode, that is, the one-to-one copying mode or the changed magnification copying mode. This is for such a purpose that the magnification can be changed in the direction of scan. If it is assumed that the speed of scan is equal to v mm/sec. at the one-to-one copying mode, the speed of scan would be changed to v/0.7 mm/sec. at a reduction of 0.7. When the original O is scanned for pre-exposure, an electrostatic latent image is formed on the photosensitive drum 1. The potential on this electrostatic latent image is detected by the potential sensor 2 and then converted into a predetermined level to produce surface potential signals. These surface potential signals are selectively inputted in the potential integrating means 41 only for the signals corresponding to the region of the electrostatic latent image from the point P to the point Q in the pre-exposure. The resulting integration is representative of the density of the image on the original O.

Although the range over which potentials to be integrated are selected is from the point P to the point Q, time required to input potential signals into the integrating means 41 may be varied depending on different speeds of the optical unit, that is, depending on whether the one-to-one or reduction copying mode is selected. If it is presumed that the distance between the points P and Q on the original is l mm, time required to integrate the surface potentials of the electrostatic latent image is l/v sec. at the one-to-one copying mode and 0.7 l/v sec. at the reduction of 0.7. Thus, the time constant in the integrating means 41 is changed to 0.7 T (where T is time constant at the one-to-one copying mode) to correct time required in the integration when a reduction copying signal is supplied from the operational part 8 to the integrating means 41.

Figure 3A:
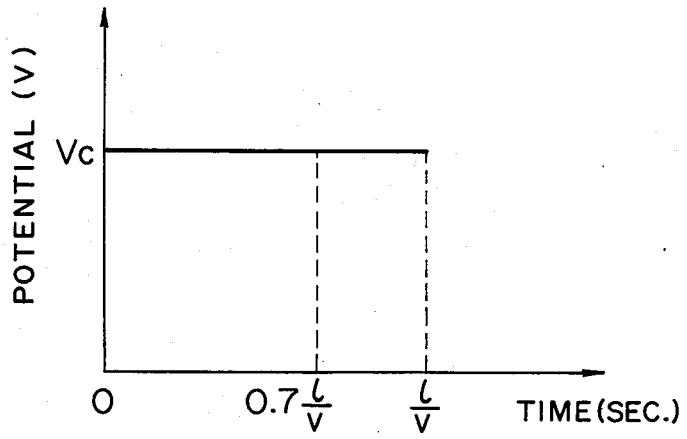
FIG. 3A is a graph showing the difference in potential between a changed magnification and the unit magnification.
Figure 3B:
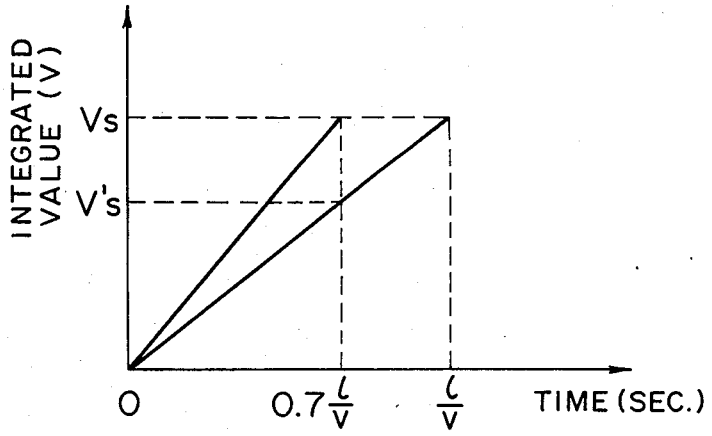
FIG. 3B is a graph showing the difference in integration corresponding to the difference of potential in FIG. 3A.

As shown in FIGS. 3A and 3B, if the original is of half-tone, which provides constant surface potential of its electrostatic latent image of Vc volts, the potential sensor functions its detection as shown in FIG. 3A.

During the detection of potential from the point P to the point Q on the original, the constant potential of Vc volts is detected for l/v seconds at the one-to-one copying mode or for 0.7 l/v seconds at the magnification changing mode. During this time period, the surface potentials on the electrostatic latent image formed on the photosensitive drum 1 are inputted to the integrating means 41 through the potential sensor 2 and potential measuring means 3. As shown in FIG. 3B, therefore, the integrating means 41 provides an integrated voltage Vs linearly increasing through l/v seconds at the one-to-one copying mode (it may approximate to a straight line if the time constant T is long enough relative to l/v or linearly rise if a Miller integrating circuit is used). At the reduction of 0.7, the gradient of the linear line is increased by about 1/0.7 while the integrated potential for the time of 0.7 l/v seconds equals to the same voltage Vs since the time constant is 0.7 T. If no correction is carried out at the reduction copying mode and when the potentials are integrated with the same time constant as in the one-to-one copying mode, the integrated voltage becomes Vs'. It is apparent that the same original O is judged as having different densities in the one-to-one and reduction copying modes. The integration so obtained is supplied to the light quantity regulating means 5 to control it such that a signal will be supplied to the lamp regulator 6 to obtain a proper amount of light in the halogen lamp 7. The above exposure and scan operation is again carried out under this controlled amount of light to provide a copy having a proper density.

Although the above description has been made as to the detection of potentials on the photosensitive drum for detecting the density of an image formed thereon, a photosensor may be disposed in the optical path for exposure such that the light for exposing the drum to the image of an original can be used to detect the density of the image. In addition to the amount of light, the developing bias and/or the width of the slit may be controlled.

In the automatic density regulating mechanism for detecting the density of the image on the original by moving the optical unit prior to the actual copying step, detecting subsequent surface potentials of the electrostatic latent image and integrating these surface potentials, the integration is corrected in accordance with a changed magnification, such that there will be no difference between the integrations at the one-to-one and changed magnification copying modes for the same density of the original. As a result, the density of the original may always be obtained as a reliable integration to adjust the exposure into a proper value.

The present invention includes the feature of correcting the error which may be caused by the change of the speed of a movable member, and it may be applied to such an automatic density regulating mechanism as includes means for correcting signals obtained as the density of the original or means for correcting any condition of image formation determined in accordance with signals representative of the density of the original, for example, at least one of the exposure and applied voltage (for light source, development, charging or the like) depending on the selected magnification.

Figure 4A:
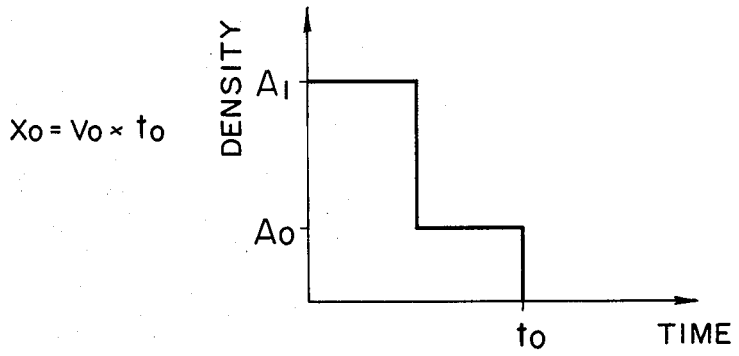
FIGS. 4A, 4B and 4C are graphs showing corrections carried out by some correcting means according to the present invention in one-to-one copying mode, an enlargement mode and a reduction mode, respectively.
Figure 4B:
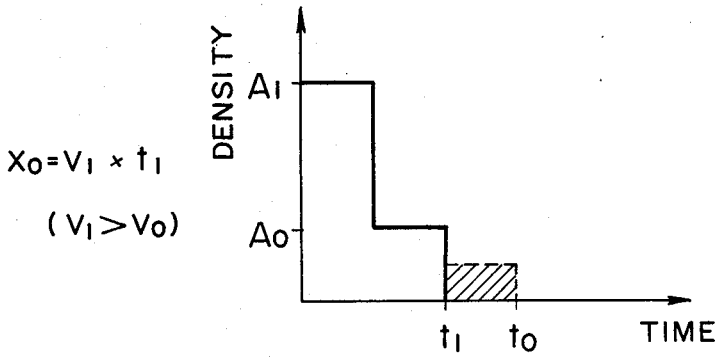
Figure 4C:
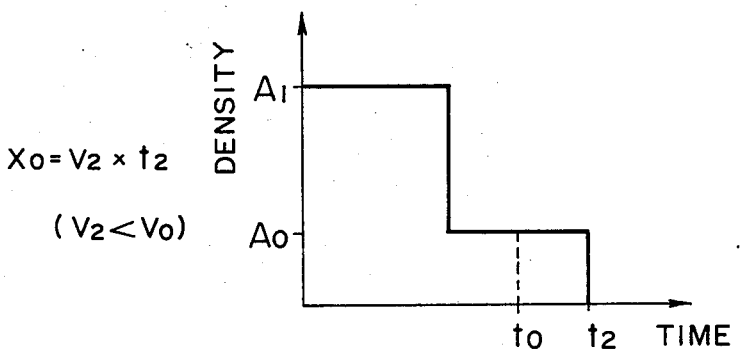

In the present embodiment, the speed of the photosensitive drum 1 is constant while the speed of the optical unit is variable. The correction control means is adapted to change the time constant of the density detecting means as will be described with reference to FIG. 7. This is effective to automatic density regulating means operated by integration. However, the present invention may be applied to the following applications:

For example, the extent of detection (the extent of scan and so on) for detecting the density of the original may be varied depending on the speed of the optical unit which is variable. This solves problems arising in the prior art wherein the time required in detection is constant. Such a problem is that false information is inputted to disable the detection of the accurate density of an original if the speed of the optical unit is changed depending on a changed magnification. The just now described embodiment of the present invention will be described with reference to graphs shown in FIGS. 4A, 4B and 4C which are, in this order, in one-to-one, reduction and enlargement magnifications. In these graphs, time t0 is one required to detect information of density in the one-to-one copying case and in the prior art. An original to be copied is indicated as having its densities A1 and A0 equal to each other in the extent of detection X0. In comparison of FIG. 4A with FIG. 4B, it has been found that if time required to detect the information of density is $t_0$ as in the prior art, unnecessary data for a period between times t1 and t0 is inputted, in the case of reduction copy, resulting in false operation, as shown by the hatched area. In order to overcome such a problem, the present embodiment changes the extent of detection represented by (speed V1 ($>$V0)$\times$time t0) in the prior art to (speed V1$\times$time t1 ($<$t0)) at the reduction. In other words, the extent of scan (V1$\times$t1) at the reduction copying mode is made substantially equal to that at the one-to-one copying mode while time required to detect the information of density is changed to (X0$\times$V1), (time t1 is represented by t0$\times$V0/V1). The false operation in the prior art can be prevented by effecting the above correction. At the enlargement shown in FIG. 4C, the needed data from time $t_0$ to time t2 is not inputted, resulting in false operation if the time is t0. In the present embodiment, the extend of detection (speed V2 ($<$V0)$\times$t0) in the prior art is changed to (speed V2$\times$time t2 (T0$>$0)) at the enlargement. In other words, the extent of detection (V2$\times$t2) is substantially equal to that at the one-to-one copying mode while time required to detect the information of density is (X0/V2) (time t2 is represented by (t0$\times$V0/V2)).

By correcting measurement time to make the extent of detection constant as described above, the density of the source of information can be controlled and detected by density detection means independently of the change of magnification or the change of speed in the optical unit. In this case, the density detection means may suitably be of either of such a type that detects the average density, that detects the maximum density or that detects the minimum density.

In still another embodiment, a cycle (period) of detection T (cycle of pulse) for detecting the density may be varied depending on the selected speed of the optical unit or the selected magnification. This overcomes such a problem in the prior art that the information of density is concentrated (at the reduction) or diluted (at the enlargement) upon change of the speed of the optical unit. More specifically, the number of pulses for detecting the information of density is maintained constant relative to a predetermined extent of scan, independently of the selected speed of the optical unit or the selected magnification. The description will now be made with reference to FIGS. 5A and 5B.

Figure 5A:
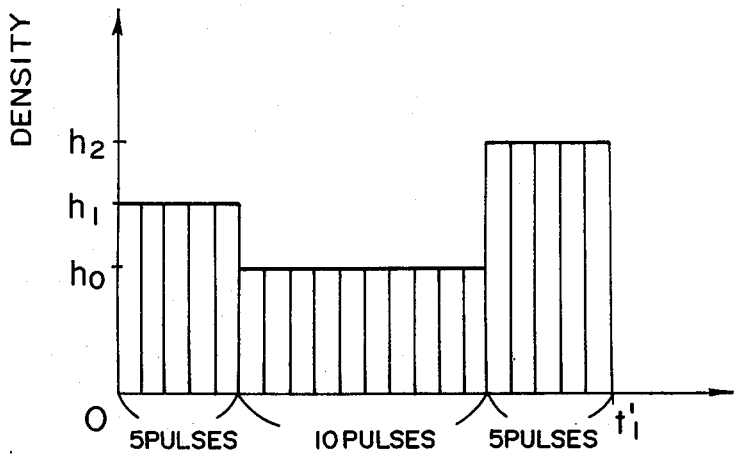
FIGS. 5A and 5B are graphs showing corrections carried out by other correcting means according to the present invention in the one-to-one copying mode and a reduction mode, respectively.
Figure 5B:
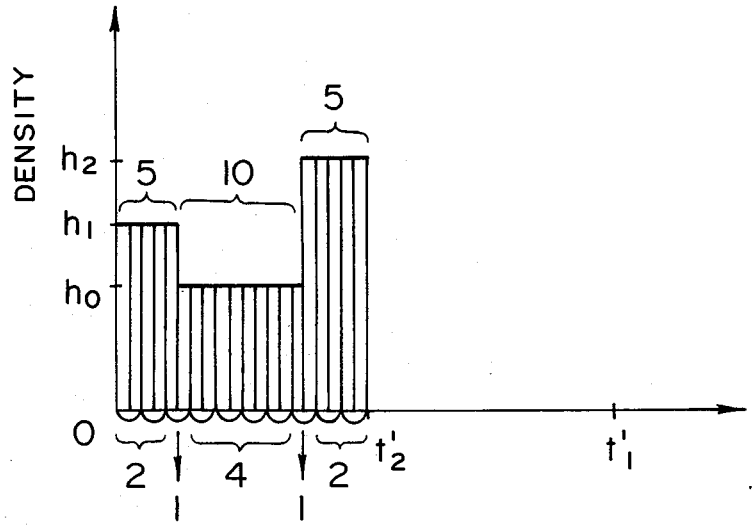

FIGS. 5A and 5B show a further embodiment of the present invention at the one-to-one copying mode and the reduction of ½, respectively. Assume that an extent of scan x is constant and times required to input information of density are t1′ (=x/v1′) and t2′ (=x/v2′) for the respective magnifications. Also, it is presumed that the speed of the optical unit is v1′ at the unit magnification and v2′ (=2v1′; >v1′) at the reduced magnification and that the pulse period T1 at the unit magnification is (20/t1′) and the pulse period T2 at the reduction is {(20/t1′)×v1′/v2′}. Since the magnification is ½, the pulse period T1=the pulse period T2×2. In other words, if a pulse cycle is T1 at the speed v1′ of the optical unit, a pulse cycle at the speed v2′ may be determined to be T1×v1′/v2′. As seen from FIGS. 5A and 5B, densities h0, h1 and h2 are obtained by ten, five and five pulses, respectively, both at the unit and reduced magnifications. The same information of density may be obtained independently of the change of speed in the optical unit.

In other words, a proper detection may be carried out by the above correction independently of the change of speed in the optical unit so that the false operation resulting in disadvantage of an image to be formed will be prevented.

If a constant pulse period is used without such a correction, each pulse period shown in FIG. 5B is the same as that of FIG. 5A, that is, two times that of FIG. 5B in the present embodiment. In this case, the densities h0, h1 and h2 are obtained by four, two and two pulses, respectively, so that the concentrated density for h0, h1 and the concentrated density for h0, h2 are obtained by one pulse, respectively. Not only in such a case that a density is detected by obtaining a number of pulses, but also in such a case that a density is detected by the pulse levels of the pulses, false operation will be produced if a constant period of pulse is used for various speeds. In the present embodiment, such a false operation can be prevented by the use of the above correction.

Although the previous embodiments have been described as to the correction made depending on the change of speed in the optical unit when the density of the original is to be detected, the present invention can be applied to such a system that the correction is made to control the condition of image formation depending on signals produced from the optical unit when it detects the density of the original at a selected speed. Such a system is shown in FIG. 6.

Figure 6:
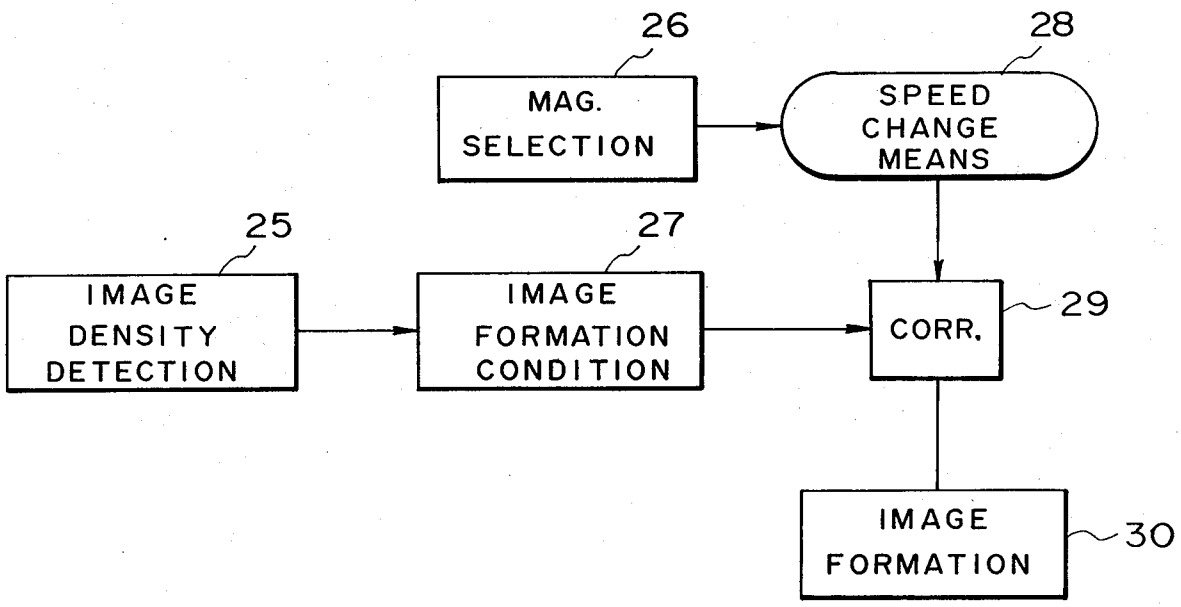
FIG. 6 is a basic block diagram showing another embodiment of the present invention.

The embodiment shown in FIG. 6 comprises an optical system which can be moved at one of various speeds corresponding to magnifications and correction means operable matching the selected speed of the optical system. If at least one of various conditions of image formation (development bias, voltage applied to the exposure lamp and so on) is determined by the known automatic density regulating means depending on density signals obtained by the known image density detecting means 25, said correction means 29 is actuated to add a correction corresponding to the change of speed of the optical system by the speed changing means 28 or the change of magnification by the magnification selecting means 26 to such a condition of image formation. Thus, an error due to the change of speed in the optical system or the change of magnification can be corrected such that a proper image will always be obtained independently of the change of speed in the optical system.

As described above, the present invention provides correction means operable depending on any selected magnification such that the automatic density regulating means can be adjusted to the change of speed in the movable optical system for forming an image to provide a proper image.

Figure 7A:
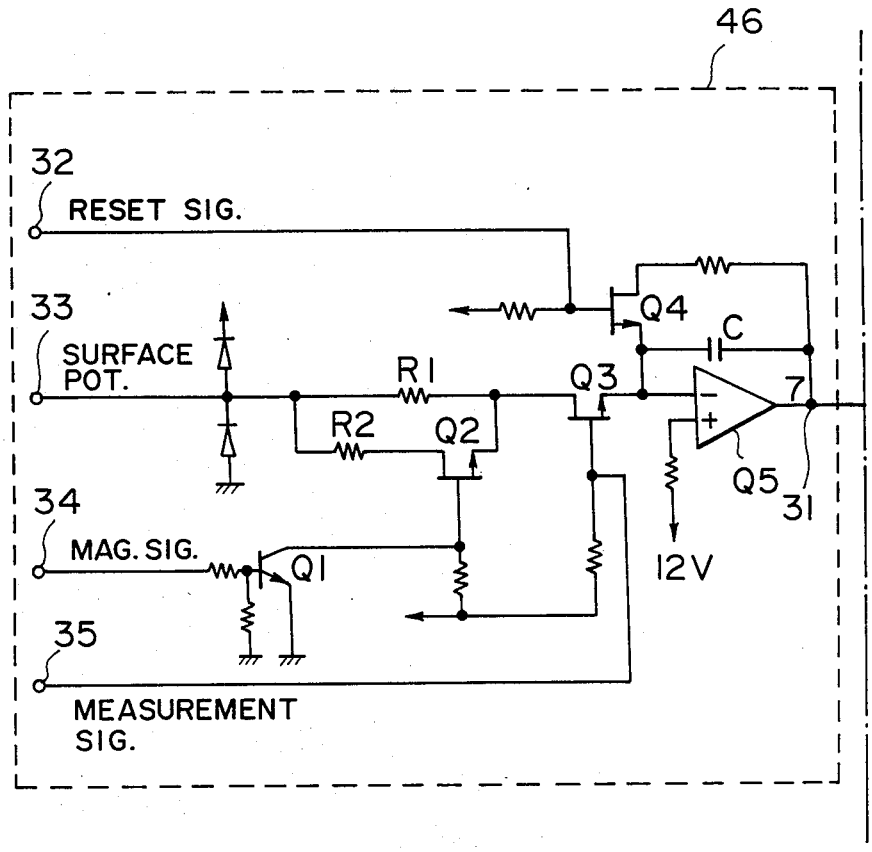
FIGS. 7, 7A, 7B is a primary circuit diagram including an integrating circuit and a correction circuit in the embodiment of the present invention shown in FIG. 2.
Figure 7B:
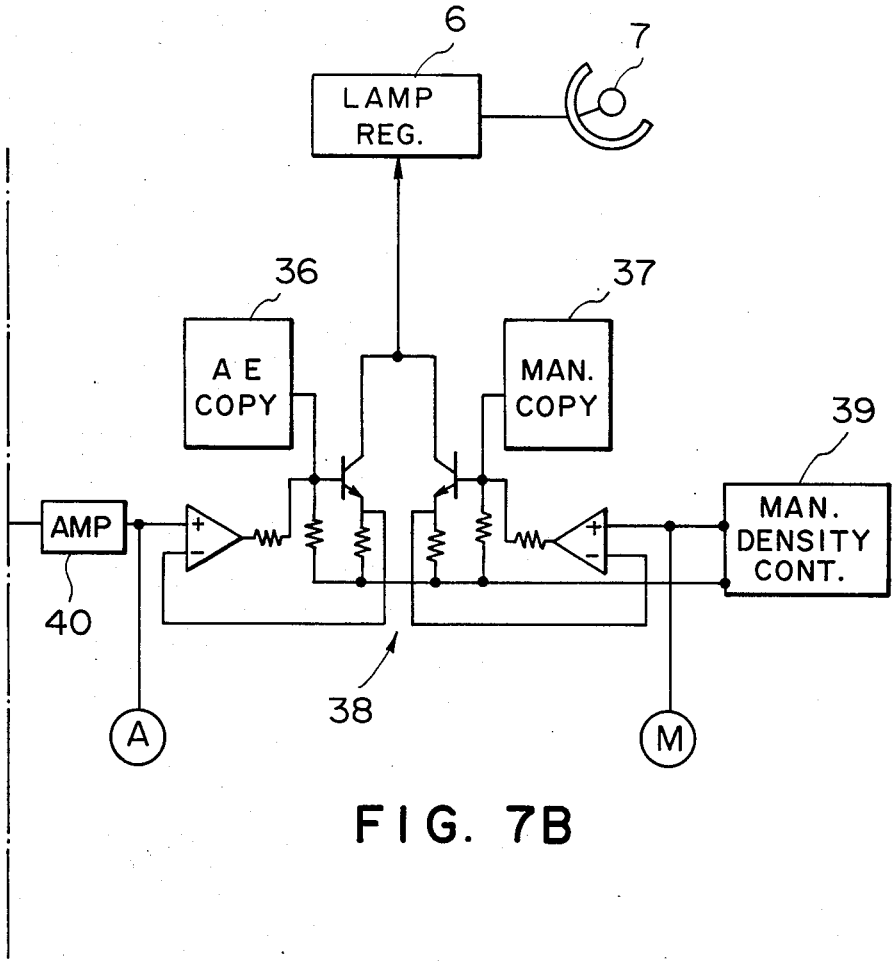
Figure 7:
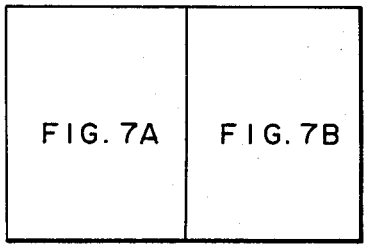

FIG. 7 shows a specific example of the embodiment shown in FIG. 2. Referring to FIG. 7, a Miller integrating circuit shown herein is adapted to control the lamp regulator for the light source 7 used to expose the original to light which is one of the above conditions of image formation. The Miller integrating circuit has its time constant which can be changed by magnification signals.

An automatic density regulating and measuring circuit 46 having a correction circuit section is provide to calculate integrations suitable for the respective magnifications in accordance with surface potential signals 33 from the potential sensor, magnification signals 34, measurement signals 35 for permitting the measurement and reset signals 32. Resistors R1 and R2 function to determine the time constant. Since no magnification signal 34 is supplied at the one-to-one copying mode, transistor Q1 is turned off and transistor Q2 is turned on to provide the time constant of R1×R2/(R1+R2). At a changed magnification, the transistor Q2 is turned off to provide the time constant of R1. The resistances of these resistors are selected such that the rate of magnification is equal to R1×R2/(R1+R2)R1. In the embodiment shown in FIG. 2, 0.7=R2/(R1+R2).

When a latent image of the original is formed on the photosensitive drum 1 and when measurement signals 35 are supplied only for a predetermined period of time, the transistor Q3 is maintained on during this time period so that capacitor C is charged under the time constant corresponding to the selected magnification. Thus, an integration corresponding to the density of the original can be obtained at junction 31.

Reset signals 32 are outputted to each of originals to be copied and to each change of magnification for the same original such that transistor Q4 will be turned on the charge the capacitor.

An amplifier circuit 40 is provided to amplify the integration obtained at the automatic density regulating and measuring circuit 46. This amplified integration may be supplied to the lamp regulator 6 through a changing circuit 38 when a signal instructing the execution of the automatic regulating mode is supplied from the automatic density regulating copy key 36 to the circuit 46. Thus, a proper output voltage for the automatic density regulating mode is applied to the lamp 7 to provide an image having its proper density independently of the selected rate of magnification.

Manual density regulating means 39 also is provided to obtain a level of density set by an operator. The density level from this means 39 is supplied from the changing circuit 38 to the lamp regulator 6 to provide the desired density when a manual mode signal is supplied to the means 39 from the manual copy key 37.

The above circuit includes means for changing time constant. If any circuit for changing time period through which measurement signals 35 are produced depending on the selected magnification, such as a timer circuit, the former circuit may be modified to have means for changing the amount or time of information.

As seen from the foregoing, the present invention provides the automatic density regulating mechanism which can be corrected to avoid any false operation upon change of magnification such that an image having its proper density will be formed independently of the change of magnification.

Particularly, the present invention can correct such a false operation as produced by the change of speed in any movable component used to form an image. Therefore, the high speed image formation can more positively be carried out to automatically regulate the density of an image to be formed with the changed magnification.

While the invention has been described with reference to the structures disclosed herein, it is not confined to the details set forth and this application is intended to cover such modifications or changes as may come within the purpose of the improvements or the scope of the following claims.

What is claimed is:

1. A variable magnification electrophotographic copying apparatus, comprising:

image forming means for applying light reflected by an original to be copied to form an image of the original, said image forming means including speed changing means for changing the speed of a movable member for image formation in accordance with a desired magnification of copy;

magnification setting means for setting a one-to-one mode wherein the image is formed in a unit magnification and a magnified mode wherein the image is formed in a non-unit magnification;

detecting means for detecting information corresponding to a density of the original using the light reflected by the original;

automatic density control means, responsive to said detecting means, for automatically controlling a density of the image formed; and automatic correcting means for correcting, in the magnified mode, said automatic density control means in accordance with the speed at which the movable member is moved based upon the magnification set by said setting means.

2. A variable magnification electrophotographic copying apparatus, comprising:

a movable electrophotographic photosensitive member;

image forming means for applying light reflected by an original to be copied to form an image corresponding to the original, said image forming means including an optical system member which is movable at a speed which is determined in accordance with a desired magnification of copy;

magnification setting means for setting a one-to-one mode wherein the image is formed in a unit magnification and a magnified mode wherein the image is formed in a non-unit magnification;

detecting means for detecting information corresponding to a density of the original using the light reflected by the original;

automatic density control means, responsive to said detecting means, for setting an image formation parameter with which said image forming means operates, and for providing the image formation parameter to said image forming means to automatically control a density of the image in an automatic density control mode; and automatic correcting means for correcting said automatic density control means in accordance with the speed at which the movable member is moved based upon the magnification set by said setting means in the magnified mode.

3. An apparatus according to claim 2, wherein said correcting means uses the set magnification for its correcting operation.

4. A variable magnification electrophotographic copying apparatus, comprising:

a movable photosensitive member;

image forming means for forming an image corresponding to an original to be copied on said photosensitive member;

magnification setting means for setting a magnification in which the image is formed on said photosensitive member;

detecting means for detecting information corresponding to a density of the original; and image density control means, responsive to said magnification setting means and to said detecting means, for setting an image formation parameter with which said image forming means operates, for a unit magnification and for a non-unit magnification, said control means including means for integrating the information of the density to adjust the parameter and means for correcting the integrating operation of said integrating means in accordance with the magnification set by said setting means in the magnified mode.

5. An apparatus according to claim 4, wherein said correcting means includes means for changing a time constant of the integrating means in accordance with the set magnification.

6. An apparatus according to claim 4, wherein said correcting means includes means for changing the information quantity with which the integrating means obtains information to be integrated in accordance with the set magnification.

7. An apparatus according to claim 4, wherein said correcting means includes means for changing the time within which the integrating means obtains information to be integrated in accordance with the set magnification.

8. An apparatus according to claim 4, wherein said correcting means includes means for maintaining a constant number of pulses of information to be integrated irrespective of the set magnification.

9. An apparatus according to claim 4, wherein said correcting means includes means for maintaining a constant detection area of information to be integrated irrespective of the set magnification.

10. An apparatus according to claim 4, wherein said image forming means includes a movable optical system member which moves at a different speed depending on the set magnification.

11. A variable magnification electrophotographic copying apparatus, comprising:

image forming means for forming an image corresponding to an original to be copied;

magnification setting means for setting a one-to-one mode wherein the image is formed in a unit magnification and a magnified mode wherein the image is formed in a non-unit magnification;

automatic density control means for controlling in an automatic mode a density of the image in accordance with information corresponding to a density of the original;

manual density control means for manually controlling in a manual mode a density of the image;

an automatic density control circuit for determining an image formation parameter with which said image forming means operates, in accordance with the information corresponding to the density of the original and with the magnification set by said magnification setting means, in the automatic mode; and a manual density control circuit for determining the image formation parameter irrespective of said automatic density control circuit.

12. An apparatus according to claim 11, wherein said automatic density control circuit includes a correcting circuit which is incorporated only in the magnified mode.

13. An apparatus according to claim 11, wherein said image forming means includes a movable member for image formation, which moves at different speeds depending on the set magnification.

* * * * *